United States Patent [19]

Cudmore et al.

[11] Patent Number: 4,596,731

[45] Date of Patent: Jun. 24, 1986

[54] GRASS PROTECTING WALKWAY GRID

[76] Inventors: Warner J. G. Cudmore, P.O. Box 3747; Doug O. Vilven, P.O. Box 2067, both of Park City, Utah 84060; H. Keith Cudmore, 305 N. Main St., Glen Ellyn, Ill. 60137

[21] Appl. No.: 651,236

[22] Filed: Sep. 17, 1984

[51] Int. Cl.[4] ..... B32B 3/10

[52] U.S. Cl. ..... 428/134; 428/44; 428/131; 428/141; 52/177; 52/180; 404/36; 404/41

[58] Field of Search ..... 428/44, 52, 131, 141, 428/134; 52/177, 180; 404/36, 41

[56] References Cited

U.S. PATENT DOCUMENTS

| | | | |
|---|---|---|---|
| 964,601 | 7/1910 | Akerson . | |
| 2,577,890 | 12/1951 | Hardy . | |
| 2,828,843 | 4/1958 | Hill . | |
| 3,772,419 | 11/1973 | Schoening . | |
| 3,786,989 | 1/1974 | Haynes . | |
| 3,802,144 | 4/1974 | Spica | 404/36 X |
| 3,836,075 | 10/1974 | Botbol . | |
| 3,858,803 | 1/1975 | Gantert . | |
| 3,925,946 | 12/1975 | Balinski . | |
| 4,008,548 | 2/1977 | Leclerc | 52/180 |
| 4,061,268 | 12/1977 | DeMaster . | |
| 4,133,481 | 1/1979 | Bennett . | |
| 4,436,779 | 3/1984 | Menconi et al. | 428/44 X |
| 4,468,910 | 9/1984 | Morrison | 404/36 X |

OTHER PUBLICATIONS

Industrial Sales Co. "Chemgrate the Ultimate in Fiberglass Grating", 12/79.

Industrial Sales Co. "Chemgrate Floor Grating & Stair Tread", 4/83.

*Primary Examiner*—Alexander S. Thomas

*Attorney, Agent, or Firm*—Trask, Britt & Rossa

[57] ABSTRACT

A grass protecting walkway having a substantially flat elongated grid-like structure which defines a plurality of polygonal apertures is disclosed. The grid allocates its bottom and top planar surface areas approximately equally between the surface area of the apertures and the surface area of structured cross members.

15 Claims, 5 Drawing Figures

GRASS PROTECTING WALKWAY GRID

BACKGROUND OF THE INVENTION

1. Field:

The present invention relates to structures adapted to protect grass seeded areas. More particularly, the new structure is an assembly of traction grids made interconnectable to form a pathway over grassy areas. Specifically, the invention is directed to a method of protecting grass which is subject to high levels of human or vehicular traffic, while simultaneously providing a traction surface for that traffic.

2. State of the Art:

The landscaping industry has long encountered the problem of providing walkways or pathways over grass seeded areas.

Typical varieties of grass, though somewhat resistent to the pounding and abrasion produced by traffic, are not sufficiently durable to withstand such continued abuse over extended periods. This vulnerability to damage in part results from the physical structure of the grass. The root structure of grass is concentrated near the soil surface. As a result, relatively small force applications can dislodge and destroy the roots. The green blade portion, though resilient, is relatively fragile and hence susceptible to serious damage should it be subjected to repeated abrasion or pounding.

Contemporary landscaping, whether in a commercial setting, e.g., parks, golf courses, or in a residential environment, often utilizes grass as an integral component of any design. Not only are lawns typically less burdensome in maintenance than other horticultural displays, e.g. flower gardens, but a wide expanse of uninterrupted grass is considered very attractive in an aesthetic sense.

As a general rule, grass use is found in areas where human or vehicular traffic is also present. The need, therefore, arises to provide grassy areas adapted to tolerate traffic while simultaneously retaining the aesthetic qualities inherent in grass seeded areas. Contemporary practice generally involves the construction of cement sidewalks, stone paths or ceramic tile walkways to address this need. Graveled walkways have also been used in some environments.

The use of these materials introduces a new series of problems. Not only are these materials expensive, they are burdensome to install and often require replacement. Furthermore, the use of these materials restricts the landscape engineer's attempt to imitate the aesthetic qualities found in natural settings. Moreover, these walkways complicate the task of mowing the grass. Oftimes the blades of the lawn mower are damaged from either hitting the walkways or ingesting gravel. In applications involving extensive pathways, such as parks, golf courses and jogging paths, the expense associated with installing and maintaining these types of pathways becomes cost prohibitive. The landscape designer is either required to sacrifice the beauty of unmarred grassy areas for a maze of cement or concrete sidewalks or alternately forego the sidewalks in favor of tolerating worn pathways.

The provision of a traction-yielding path surface has received some technical attention. In U.S. Pat. No. 964,601 (Akerson) a portable track for use in assisting automobiles and similar vehicles is disclosed. Akerson teaches the use of an assemblage of fabric, preferably canvas, which is securely stitched together to form a flexible path structure. The structure has a top surface possessing a high coefficient of friction. The fabric assembly, being essentially nonporous, is nonconducive to long term placement over a grassy surface. Not only would the grass covered by the mat be damaged for lack of sunlight, the relatively slick nature of the blade portion of the grass would fail to secure the mat. A force component directed to the mat parallel to the ground, as would typically be the case in the motion of a wheeled vehicle, would dislodge the mat. The provision of a traction surface for the vehicle would therefore be frustrated.

U.S. Pat. No. 3,836,075 to Botbol teaches the use of a cleated mat having means therein to interconnect a plurality of such mats to form a path. Similar to Akerson in its requirement of a nonporous base structure, Botbol's mat structure would create similar problems to those engendered by Akerson if placed over grass.

A grid-like mat intended for use over hard surface areas such as asphalt or concrete is manufactured and sold under the trademark "Duragrid" by Duragrid, Inc. of Salt Lake City, Utah, a subsidiary of Sport Court of America, Inc. of Midvale, Utah. The "Duragrid" mat consists of a lattice-like structure having a series of square apertures averaging approximately one quarter square inch in area. The "Duragrid" mat is adapted for renovating hard surfaces which have weathered or deteriorated. The use of this structure over grassy surfaces is counter producproductive because of the restricted size of the lattice apertures. The small apertures don't permit sufficient light and circulation to promote grass growth. Downwardly directed forces as provided by traffic eventually submerge the "Duragrid" mat into the soil, thereby nullifying any grass protective attributes of the grid. Traction mats for assisting in dislodging automobiles from snow, ice and similar obstacles are disclosed in U.S. Pat. No. 3,786,989 (Haynes); U.S. Pat. No. 4,061,268 (Demaster); and U.S. Pat. No. 2,577,890 (Hardy).

SUMMARY OF THE INVENTION

A grass protecting grid in accordance with the present invention consists of an assemblage of small, easily managed, flat, substantially rigid plates. Each plate is adapted with a plurality of systematically arranged apertures therein. When the plate is placed over grass, the apertures establish gripping surfaces between a wheel or foot and the plate and between the plate and the grass. Typically, the apertures are polygonal in configuration and are aligned in a series of linear rows, which rows parallel the sides of the plate.

The grid may also be viewed as an elongate assemblage of two distinct series of linear members. Each series consists of a collection of parallel, substantially uniform linear strips. The two series are arranged with the first series being substantially perpendicular to the second series. The resulting configuration, essentially a lattice work, defines a plurality of quadrilateral apertures. The linear members are integrated at their points of intersection, thereby forming a flat planar surface. The configuration presents a surface of sufficient regularity to permit foot or vehicular traffic.

The apertures are typically square in configuration, though other configurations may also be used. The shape of the apertures may be varied providing the allocation of surface area between linear members and apertures, hereinafter decribed, is maintained.

The grid structure is adapted to not only provide a durable traction surface, but also to protect the grass beneath the grid surface. The grid therefore must be retained level with if not above the roots of the grass. In essence, the grid is structured to mesh with the grass and be concealed therein. In use the grid retains the aesthetic quality of a grassy area while simultaneously maintaining an environment conducive to the growth and protection of the grass.

Obtension of these objectives is achieved by dimensioning the linear members and arranging their placement so as to define apertures whose surface areas are about one to about four square inches. This dimensioning is deemed critical in that it permits sufficient light, air, and moisture to reach the grass while still presenting an adequate traction surface. The area of the individual apertures is coordinated with the dimensioning of the linear members such that the surface area of the grid is approximately evenly divided between linear members and apertures. This allocation of surface area achieves the result of permitting healthy grass growth while also distributing any force application to the grid over an expanded area and preventing the grid's submergence into the soil.

An important feature of the invention is that each grid is provided with means for positive, but releasable, interconnection of two or more grids whereby a pathway or series of grids can then be assembled into a pathway.

The grid is typically fitted on its bottom surface with a plurality of securing means adapted for securing or mooring the grid into the grass.

Ideally, the upper surface of the grid is textured, or otherwise adapted, to effect a high coefficient of friction.

DETAILED DESCRIPTION OF THE ILLUSTRATED EMBODIMENT

Figure 1:
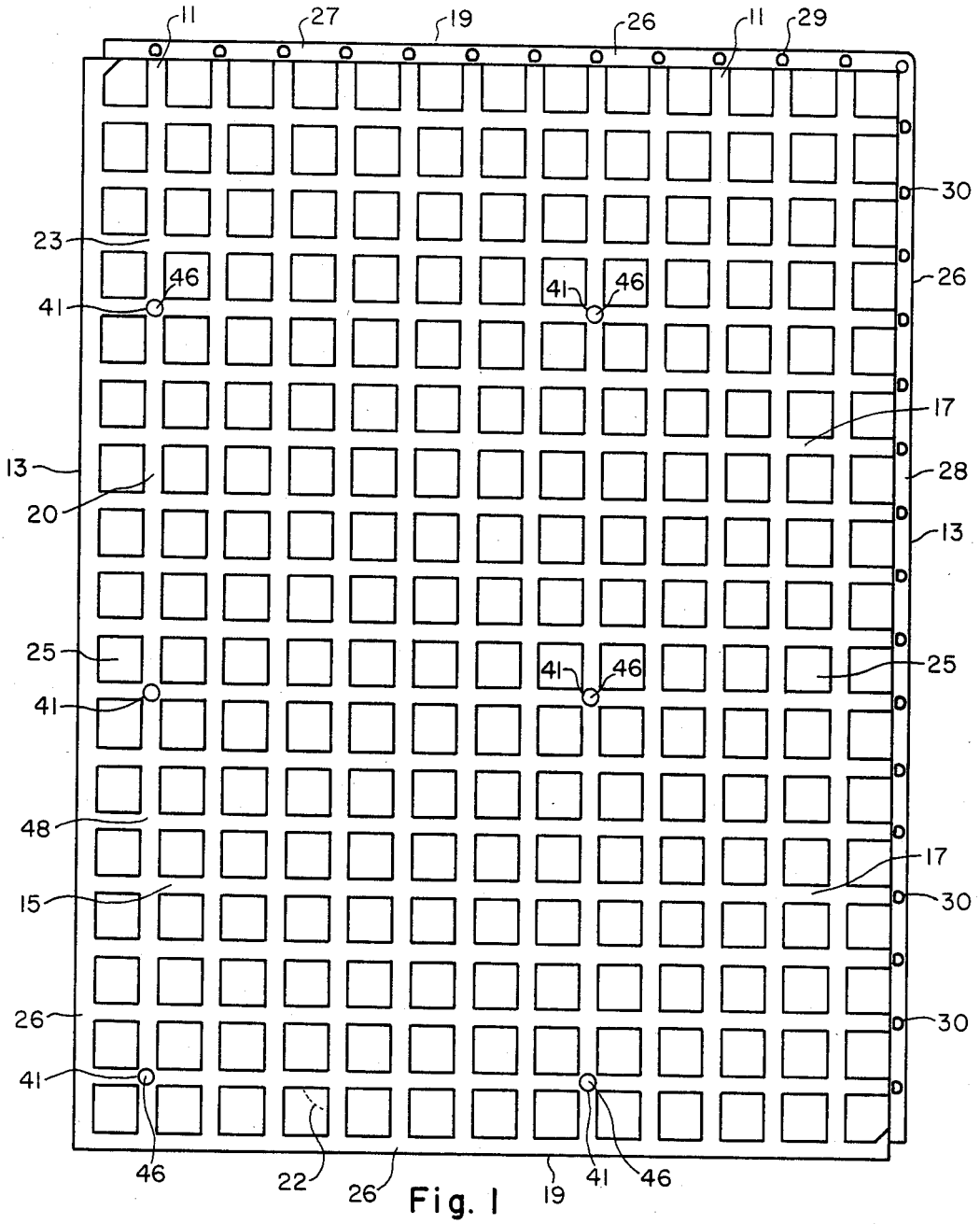
FIG. 1 is a planar view of the protective grid of this invention detailing the allocation of surface area between openings and linear members.
Figure 2:
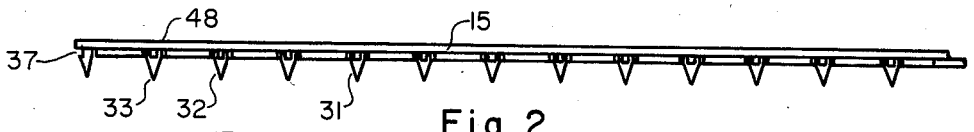
FIG. 2 is a side view of the grid of FIG. 1 illustrating conical securing means depended from the bottom surface of the grid.

FIG. 1 shows a first plurality or series of parallel linear strips 11 arranged in parallel with the sides 13 of an elongated generally rectangular grass protecting mat or grid, generally 15. A second series of parallel linear strips 17 is positioned in parallel to sides 19 of the grid 15. The strips of both series typically have equivalent dimensions. In a preferred embodiment, the strips have a rectangular cross section including a surface width 20 of approximately one-half ($\frac{1}{2}$) inch, though variations may range between about one-fourth ($\frac{1}{4}$) inch to about three-fourths ($\frac{3}{4}$) inch. Each strip generally has a thickness 20 of approximately one-quarter ($\frac{1}{4}$) inch.

In a preferred embodiment, the first series of linear strips 11 is positioned with respect to the second series 17 such that the strips of the two series intersect one another at an angle 22 of approximately 90°. Alternate angles may be selected without detracting from the functionality of the grid. The intersections 23 of the two series of strips are shown as being adapted, to present a flat somewhat regular planar surface. The intersections 23, being typically at right angles, generally define a plurality of quadrilateral apertures 25. The apertures 25 extend through the total thickness of the grid 15 and typically retain a constant diameter over their length. In the illustrated embodiment, the apertures 25 are square.

The strips 26 placed at the perimeter of the grid serve to define sides 13 and sides 19. A preferred embodiment arranges the strips so as to form a grid which is approximately 30 inches in length and about 23 inches in width.

The apertures 25 are configured to have a bottom and a top surface area. Each of those surface areas may vary dimensionally in any given plate from approximately one to about four square inches. In a preferred embodiment, the surface area of each opening is approximately 1 9/16 square inches.

As shown in FIG. 1, grid 15 is fitted on one side 27 and one side 28 with an interlocking means adapted to connect one grid to another. As shown, this interlocking means may consist of adapting sides 27 and 28 with a plurality of spaced apertures 29 therein. These apertures 29 are dimensioned to slidably receive and securely embrace a plurality of male connectors 31 which depend from a second grid 16. Typically, connectors 31 are mounted along a side 13 and/or a side 19 of the plate. A preferred embodiment contemplates the placement of both a plurality of apertures 29 and a plurality of male connectors 31 on each grid plate. Typically, the apertures are placed on two sides, e.g., a side 13 and a side 19, with the connectors being mounted on the remaining sides, e.g., the remaining side 13 and remaining side 19. As shown, these male connectors 33 may be configured as a plurality of conical members 32, each member having its base secured to the grid 15 with the apex 33 of the member being directed perpendicularly away from the grid 15.

Figure 5:
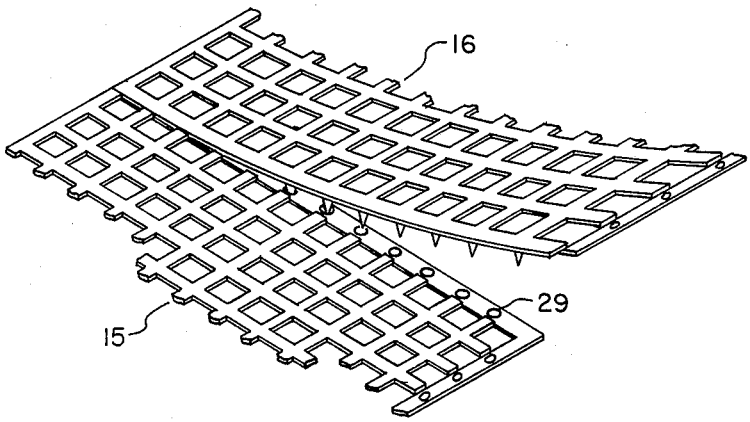
FIG. 5 is an elevational view showing the interconnection of two grids of this invention.

In an assembled condition, a row of conical members 32 of one grid 15 is aligned with a row of apertures 29 of a second grid and slidably inserted into said apertures as shown in FIG. 5. The conical members are configured with a slot 37 which functions to releasably lock the conical member into connected relationship with its respective corresponding opening 29. Utilizing this securement means, a plurality of grids may be interlocked to construct an extended pathway, or alternatively, in a fixed relationship, an extensive surface area.

Figure 4:
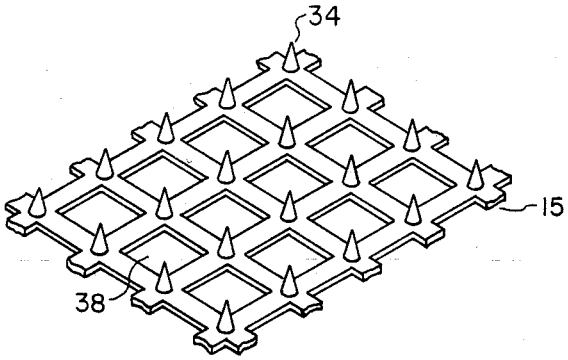
FIG. 4 is a partial view of the grid of FIG. 1 showing the grid's reverse side.

FIG. 4 shows a ground securing means 34 affixed to the bottom side of a grid 15. As shown, the means may be conical members though alternate configurations are within contemplation, e.g., cylindrical members, truncated cones. In a preferred embodiment, each intersection 23 of linear strips 11 and 17 is fitted with a conical member 34. These conical members 34 are structurally identical to those described as male connectors 31 with the exception that a slot 37 is not included in the members. The bottom surface 38 therefore presents a plurality of conical members 34 arranged in parallel rows which parallel the sides 13 and sides 19 of the grid 15. In operation, the conical members 34 are inserted into the soil, the apex of the member being directed into the soil, and serve to secure or moor the grid in position.

Figure 3:
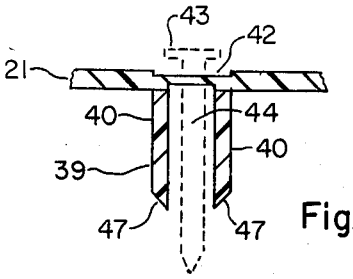
FIG. 3 is a side view of a grid showing securing means which include a nail-like member in (phantom).

FIG. 3 illustrates an optional secondary securing means, generally 39, which includes a retaining sheath-like structure 40 mounted on the bottom surface of grid 15 at a plurality of locations 41. Locations 41 are adapted with countersunk impressions 42 configured to receive the head 43 of a nail-like member 44. The member 44 is inserted through an aperture 46 in grid 15 and is received and housed within sheath 40. The head 43 is housed within impression 42 so as to retain the planar surface configuration of the grid. Sheath member 40 may include angulated ends 47 adapted to facilitate the sheath's entrance into the grass and soil.

The top surface 48 of the grid 15 is generally adapted with a finish having a high coefficient of friction thereby facilitating traction.

The grid 15 is preferably fabricated from a material having a density approximately equal to that of water, e.g., polyethylene or polypropylene. A typical construction material has a specific gravity of about 0.96, i.e. approximately the density of water. This material choice aids the grid in resisting any tendency to float or detach itself from its mooring area, in the event of surface water.

Approximately fifty percent (50%) of the top as well as the bottom planar surface area of the grid is allocated to the planar surfaces of the linear members. Thus, the grid presents a top and bottom surface of a breadth sufficient to diffuse any force application over an extended area. Furthermore, the bottom grid surface is sufficiently expansive that downwardly applied force applications to the grid are counterbalanced by normal forces acting on at least approximately fifty percent (50%) of the grid surface area impacted by the force application.

This contruction mollifies any tendency of the grid to cut or crush the grass, especially the root structure thereof. Instead, the grid is essentially cushioned over the grass, and obtains a relatively stable positioning above the roots of the grass sufficient to protect that infrastructure. Lesser allocations of surface area to linear member surface has resulted in grids which submerge into the soil, damaging the grass as they submerge. Such grids typically are pressed sufficiently into the soil that any protective function for the grass is substantially negated.

In a preferred embodiment, the grid possesses a substantially rigid, yet somewhat flexible, construction. This flexibility permits some "give" to accommodate slight irregularities in the grass surface.

Functionally, the orientation of the apertures provide an adequate traction surface for vehicle wheels while also accommodating foot traffic. In use on golf courses, the grid surface configuration adequately simulates the "response" of a grass seeded area when struck by a golf ball, i.e. the ball's bouncing action on the grid is substantially equivalent to that obtained on grassed surfaces. Therefore, not only is the grass protected, and an adequate traction path provided without marring the aesthetics of the landscape, but furthermore, the golfer's play is substantially unhindered by an artificial barrier.

The grid of this invention is typically fabricated from ultraviolet stabilized materials though the invention is not limited thereto. Generally, the grid is fabricated in a color approximating that of the grass over which it is to be installed, though the invention is not limited to that color, i.e., other colors are within contemplation. In situ, the grid becomes almost imperceptible as the grass grows through the apertures, and the grid settles into the mat of the grass. As a result, the aesthetics of the environment are essentially retained.

In addition to placement over grass seeded areas, the grid of this invention may also be used over concrete or hard surfaces, e.g., locker rooms, food preparation areas, etc. In this alternate environment, the conical members support the grid surface above the floor sufficiently to permit dust, dirt and similar refuse to fall through the apertures and be removed from interferring with traffic.

We claim:

1. A protective walkway for use in grass having a substructure, said walkway comprising a rigid, substantially flat elongated grid having opposite sides and opposite ends and a top and bottom surface, said grid comprising a first plurality of parallel oriented linear strips positioned with respect to a second plurality of parallel oriented linear strips, thereby defining a plurality of polygonal apertures, each of said apertures having a planar surface area of between about one and about four square inches, said grid having planar surface areas which are approximately equally allocated between the surface area of said linear members and the surface area of said apertures wherein a securing means adapted to secure said grid within said grass is mounted on said walkway and wherein said securing means comprises a plurality of substantially conical members adapted to penetrate said grass affixed to the bottom surface of said grid whereby a portion of said grass extends through said apertures and said linear strips are brought into abutment with the substructure of said grass.

2. The walkway of claim 1 wherein said grid is fitted with interlocking means adapted to releasably interconnect said grid with one or more grids.

3. The walkway of claim 2 wherein said interlocking means comprises a panel member affixed to at least one end and one side of said grid, said panel defining a plurality of connection apertures therein adapted to slidably receive and releasably embrace a plurality of said conical members affixed to the bottom surface of a second said walkway.

4. The walkway of claim 3 wherein said walkway is fabricated from a material having a density approximately equal to the density of water.

5. The walkway of claim 4 wherein said grid apertures are square in shape.

6. The walkway of claim 5 wherein said top surface of said walkway is textured so as to produce a surface having a high coefficient of friction.

7. The walkway of claim 2 wherein said interlocking means comprises a panel member affixed to at least one end and one side of said grid, said panel defining a plurality of connection apertures therein adapted to slidably receive and releasably embrace a plurality of said securement members affixed to the bottom surface of a second said walkway.

8. A grass protecting walkway grid having opposite sides, opposite ends and a top and bottom surface comprising:

a first series of substantially rigid linear strips extending somewhat parallel to and between said ends, having a top surface of between about $\frac{1}{4}$ and about $\frac{3}{4}$ inches in width;

a second series of substantially rigid linear strips extending parallel to and between said sides, said cross members having top surfaces of between about $\frac{1}{4}$ and about $\frac{3}{4}$ inch in width, said second series of linear strips being positioned perpendicularly to said first series of linear strips thereby forming a grid defining a plurality of quadrilateral apertures therein, each opening having at least one planar surface area of between about one and about four square inches; wherein the top and bottom surface of said grid is approximately equally divided between the planar surface area of said linear strips and the surface area of said apertures;

a plurality of salient members secured perpendicularly to the bottom surface of said grid, said salient members being secured to the points of intersection of said first series of linear strips with said second series of linear strips;

at least one panel member secured to either one end or one side of said grid, said panel member defining a plurality of apertures therein adapted to slidably receive and releasably embrace a plurality of conical members affixed to the bottom surface of a second said grid, thereby forming a releasable union of said grid with said second grid.

9. The grid of claim 8 wherein said quadrilateral apertures are square.

10. The grid of claim wherein said intersections of series of linear strips and said second series of cross members are integrated to form a regular somewhat planar surface area.

11. The grid of claim 10 wherein said grid is fabricated from a material having a density approximately equal to the density of water.

12. The grid of claim 11 wherein said grid has a top surface which is textured to have a high coefficient of friction.

13. The grid of claim 11 wherein said salient members are substantially cylindrical.

14. The grid of claim 11 wherein said salient members are substantially conical.

15. A protective walkway for use in grass having a substructure, said walkway comprising a rigid, substantially flat elongated grid having opposite sides and opposite ends and a top and bottom surface, said grid comprising a first plurality of parallel oriented linear strips positioned with respect to a second plurality of parallel oriented linear strips, thereby defining a plurality of polygonal apertures, each of said apertures having a planar surface area of between about one and about four square inches, said grid having planar surface areas which are approximately equally allocated between the surface area of said linear members and the surface area of said apertures wherein a securing means adapted to secure said grid within said grass is mounted on said walkway and wherein said securing means comprises a plurality of securement members adapted to penetrate said grass affixed to the bottom surface of said grid whereby a portion of said grass extends through said apertures and said linear strips are brought into abutment with the substructure of said grass.

* * * * *

UNITED STATES PATENT OFFICE

CERTIFICATE OF CORRECTION

Patent No. 4,596,731 Dated June 24, 1986

Inventor(s) Warner J. G. Cudmore et al.

It is certified that error appears in the above-identified patent and that said Letters Patent are hereby corrected as shown below:

Col. 7, line 21 (Claim 10), between "claim" and "wherein" insert ---9---.

Signed and Sealed this

Seventh Day of October, 1986

[SEAL]

*Attest:*

DONALD J. QUIGG

*Attesting Officer*

*Commissioner of Patents and Trademarks*